United States Patent [19]

Rumble

[11] 4,395,082

[45] Jul. 26, 1983

[54] OBTURATOR

[76] Inventor: Clive S. Rumble, Apt. 2106, 330 Spadina Rd., Toronto, Canada

[21] Appl. No.: 153,523

[22] Filed: May 27, 1980

[30] Foreign Application Priority Data

Jun. 1, 1979 [GB] United Kingdom ..... 7919147

[51] Int. Cl.[3] ..... H01R 13/44

[52] U.S. Cl. ..... 339/41

[58] Field of Search ..... 339/41

[56] References Cited

U.S. PATENT DOCUMENTS 2,532,219 11/1950 Bierce ..... 339/41

3,853,376 12/1974 Marechal ..... 339/41

4,236,052 11/1980 Haase ..... 339/41 X

*Primary Examiner*—Joseph H. McGlynn

*Attorney, Agent, or Firm*—Parkhurst & Oliff

[57] ABSTRACT

An obturator for closing an opening, especially of use in an electrical plug socket adaptor, the obturator comprising in combination three apertured plates in which the apertures are able to be aligned so that entry from the apertures of the first plate to the apertures of the third plate via the apertures of the second plate is only possible by movement of the second plate; in the natural condition of the obturator entrance to the apertures of the third plate is obstructed by the second plate.

3 Claims, 20 Drawing Figures

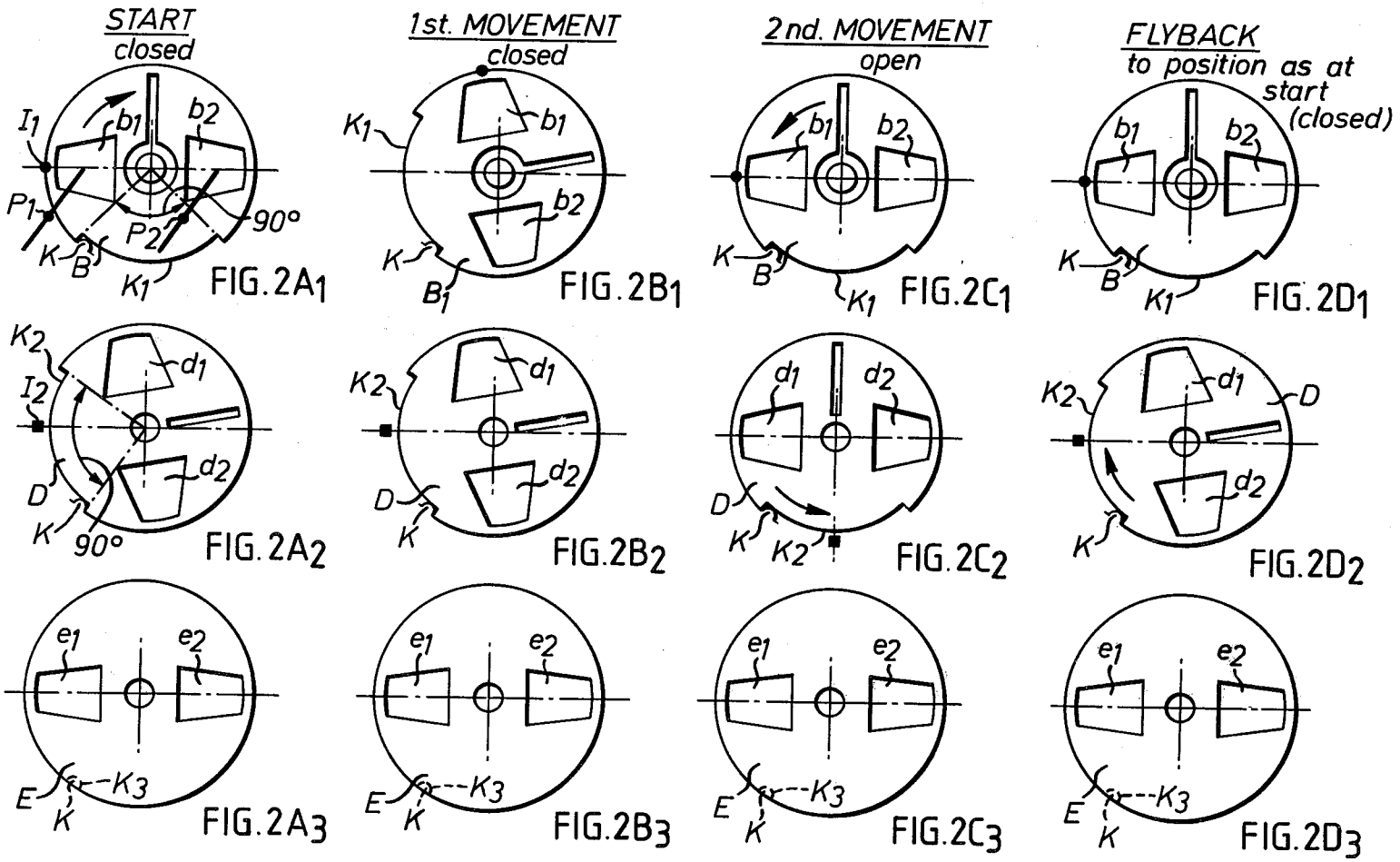
START
closed
1st. MOVEMENT
closed
2nd. MOVEMENT
open
FLYBACK
to position as at
start
(closed)
FIG. 2A1
FIG. 2A2
FIG. 2A3
FIG. 2B1
FIG. 2B2
FIG. 2B3
FIG. 2C1
FIG. 2C2
FIG. 2C3
FIG. 2D1
FIG. 2D2
FIG. 2D3
90°
90°

OBTURATOR

This invention relates to an obturator, that is to say an artificial device for stopping an opening. It is more specifically related to the need required at law for the closing of openings in various electrical devices that would lead directly to one or more live members of an electrical supply and hence form a hazard, especially to children. It may be used to advantage at the end of an electrical plug suitable for use with a variety of electrical outlets and configurations for electrical supplies around the world.

According to the present invention there is provided an obturator comprising in combination an apertured first plate that has an aperture aligned or able to be aligned with an aperture third plate between which is juxtaposed a second plate that obstructs entry from said aperture of said first plate to the aperture of said third plate, said first plate being movable to allow said aperture therein to be aligned with an aperture in said second plate thereby permitting entry therethrough so that when said first and second plate are moved together entry may be made from their apertures to the aperture of said third plate.

In an improved obturator for use especially in certain stringent electrical conditions wherein each of the apertured plates have two apertures to receive two prongs of an electrical connector the apertures of the second plate are not rotatable or slideable to uncover the apertures in the third plate until detent means operable by the two said prongs are actuated. The detent means may conveniently be spring actuated members moveable in the direction of entry of the said prongs.

The invention will be more fully understood from the following description given below by way of example only with reference to the figures of the accompanying drawings in which:

FIG. 1 is an exploded view in oblique perspective of an obturator of the invention;

FIG. 2 (comprising FIGS. $2A_1$ to $2D_3$) is a schematic showing a sequence of operations when the obturator is in use with a plug;

Figure 1:
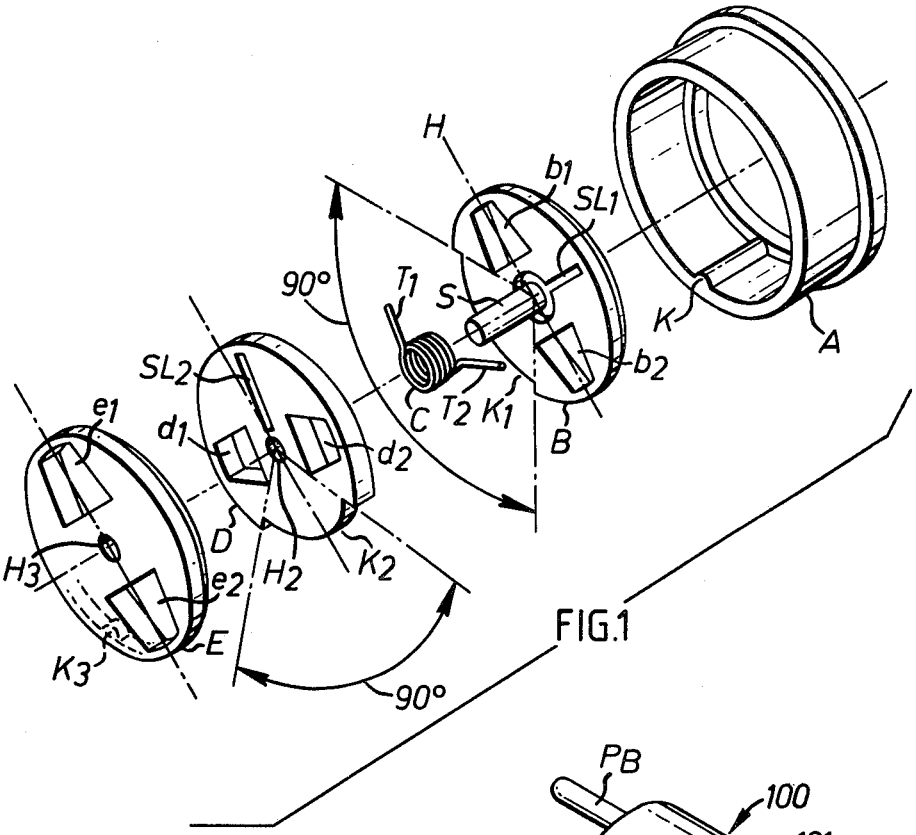

Referring now to FIG. 1 an obturator is seen to comprise five members, a shutter ring A, a first plate B, a spring C, a second plate D and a third plate E. Shutter ring A contains a key K, that is aligned with a keyway recess $K_1$ in the first plate B and $K_2$ in the second plate arc. A further keyway recess $K_3$ in third plate E (shown dotted) aligns exactly with key K. Two diametrically disposed apertures $b_1$, $b_2$, $d_1$, $d_2$, $e_1$, $e_2$ are formed respectively in each of the three plates B, D and E and these are identical in size and form, but their disposition in respect of the keyways $K_1$, $K_2$, $K_3$ are different. First plate B has a central spigot S which mates with central holes $H_2$, $H_3$ in plates D and E respectively. Spigot S also receives helical spring C the tines $T_1$, $T_2$ of which are placed respectively in slots $SL_1$, $SL_2$ so that when assembled, plates B and C are spring urged and disposed as explained below with special reference to FIGS. 1 and 2.

Consider a two pronged plug $P_1$, $P_2$ (FIG. $2A_1$) being entered at apertures $b_1$, $b_2$ of first plate B said prongs $P_1$ $P_2$ can not pass because they are blocked by the second plate D (FIG. $2A_2$) and hence the said prongs $P_1$, $P_2$ cannot connect with electrical contacts at apertures $e_1$, $e_2$ of third plate E (FIG. $2A_3$).

Consider now that the prongs $P_1$, $P_2$ are made to rotate first plate B through about a right angle to the position $B_1$ (FIG. $2B_1$) by virtue of keyway recess $K_1$. The rotational position of the plate is made clear by the circular identification dot on its periphery (marked $I_1$ in FIG. $2A_1$ only) so that apertures $b_1$, $b_2$ are now aligned with apertures $d_1$ $d_2$ in second plate D (FIG. $2B_2$) the position of this plate in rotation may be followed from the square identification dot on its periphery (marked $I_2$ in FIG. $2A_2$ only). The prongs $P_1$, $P_2$ cannot, however, enter the electrical contacts at apertures $e_1$ $e_2$ (FIG. $2B_3$) since they are blocked by the third plate E.

Consider further that both plates B and D are now rotated together (FIGS. $2C_1$, $2C_2$) through about a right angle by the prongs $P_1$, $P_2$ and that apertures $b_1$ $b_2$ and $d_1$ $d_2$ are now aligned with apertures $e_1$ $e_2$ so that the prongs $P_1$, $P_2$ now are able to be forced into contacts at $e_1$ $e_2$ of plate E (FIGS. $2C_1$, $2C_2$, $2C_3$). Let the prongs $P_1$, $P_2$ now be withdrawn (FIGS. $2D_1$, $2D_2$, $2D_3$). Clearly first plate B (FIG. $2D_1$) is as it was ab initio in FIG. $2A_1$; but second plate D now rotates from position $2C_2$ to $2D_2$ under the action of spring C to the position that it enjoyed in FIG. 1. The position as shown in FIGS. $2D_1$, $2D_2$, $2D_3$ makes it abundantly clear that entry to electrical contacts at $e_1$, $e_2$ (FIG. $2D_3$) is not now possible since entry apertures $b_1$ $b_2$ (FIG. $2D_1$) are obstructed by second plate D the apertures $d_1$ $d_2$ (FIG. $2D_2$) being out of alignment with both $b_1$ $b_2$ and $e_1$ $e_2$.

Figure 3:
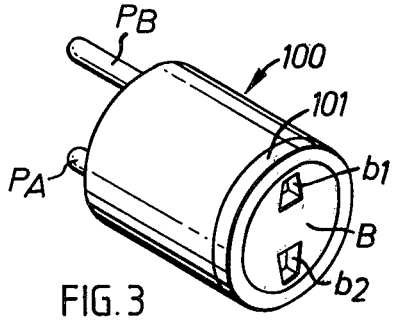
FIG. 3 is a view in oblique perspective of an obturator of FIG. 1 fitted to a simple plug.

In FIG. 3 a simple two prong adaptor plug shown generally at 100 is fitted at 101 with an obturator as shown in FIGS. 1 and 2. When prongs $P_A$ $P_B$ are entered into an electrical outlet the obturator 101 via first plate B and entry apertures $b_1$ $b_2$ prevent an appliance being connected to the supply unless the sequence of events described above with regard to FIGS. $2A_1$ to $2D_3$ inclusive are effected.

Figure 4:
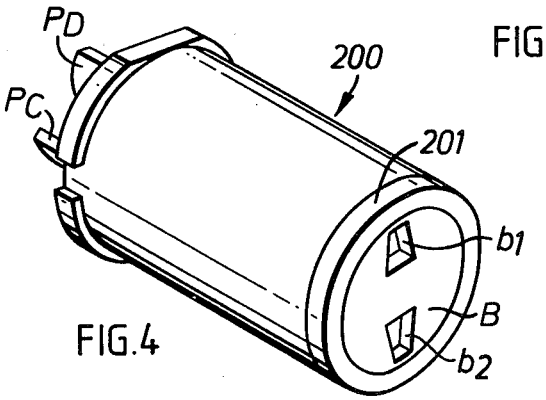
FIG. 4 is a view in oblique perspective of an obturator of FIG. 1 fitted to a complex adjustable plug for use with the various electrical outlets sockets of various countries of the world.

In FIG. 4 a complex adaptor plug shown generally at 200 is used to meet the needs of various electrical outlet configurations around the world, said plug contains right cylindrical prongs (not shown ) of two sizes and spacings together with rectangular prismatic prongs $P_C$ $P_D$ able to take up a variety of angular dispositions shown in FIGS. 1 and 2. When prongs $P_C$, $P_D$ are entered into an electrical outlet the obturator 201 via first plate B and entry apertures $b_1$, $b_2$ prevent an appliance being connected to the supply unless the sequence of events described above with regard to FIGS. $2A_1$ to $2D_3$ inclusive are effected.

Clearly the angle shown between the position of plate B in FIGS. $2A_1$ and that of FIGS. $2B_1$ may be exactly a right angle provided the recess $K_1$ is greater than a right angle by the width of key K in ring A.

It is to be understood that the obturator of FIG. 1 may have utility in a wide variety of applications, for example it may make a safety lid to a bottle or box containing medicaments in pill, lozenge or capsule form; the stopping of the opening preventing access by a child, but giving ready access to an adult using a prong like opening means and with a knowledge of for example the sequence of events expressed in FIGS. $2A_1$ to $2D_3$.

It can be shown that a two pronged electrical plug (FIG. 3) for example may be positively yet foolishly used such that one prong only ($P_A$) when inserted at aperture $b_1$ for example (FIG. 1) may be used to rotate the first plate and place the prong ($P_A$) into an electrically live condition with the other prong ($P_B$) also live yet outside the adaptor case and thus exposed to the operator.

Figure 5:
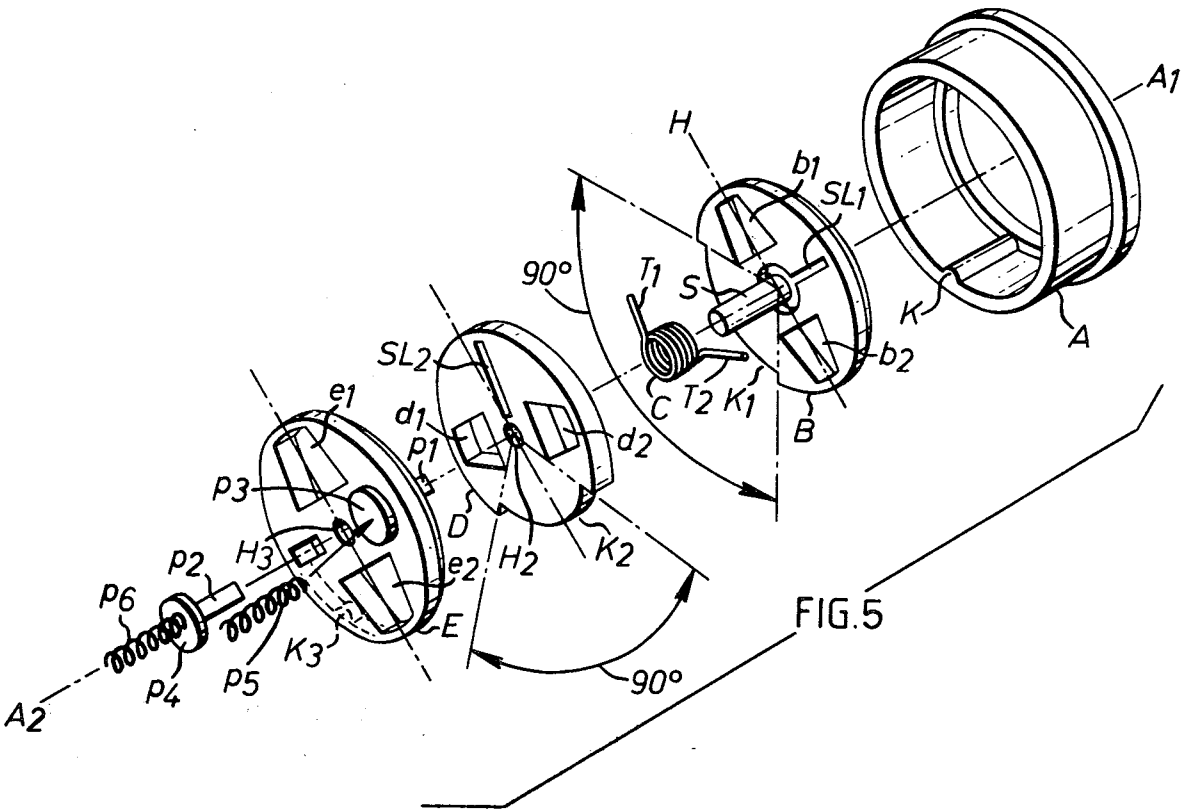
FIG. 5 is an exploded view of an improved obturator similar to that shown in FIG. 1 with axial detent means.

To prevent such a situation arising an obturator as shown in FIG. 5 may be used. Third plate $E_1$ is provided with detent means comprising a pair of protuberances $P_1$, $P_2$ each having a base part $P_3$, $P_4$ that is in effect a spring plate to helical compression springs $P_5$, $P_6$ that apply force axially of the obturator along axis $A_1$, $A_2$ and about the end of the obturator case not shown.

It is clear that rotation of the second plate cannot take place until protuberances $P_1$, $P_2$ are each removed from apertures $d_1$, $d_2$ of the second plate; to do this both prongs of an entering plug must simultaneously depress $P_1$, $P_2$ from out of the apertures $d_1$, $d_2$ before it can be rotated. If a single prong were to be inserted then the removal of a single protuberance would leave the other protuberance within an aperture and rotation of the second plate would not be possible.

Figure 6A:
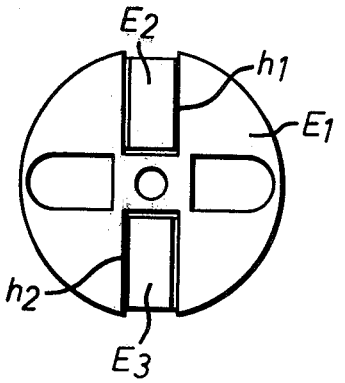
FIGS. 6A, 6B, 6C, 6D are four views of an alternative detent means to that shown in FIG. 5.
Figure 6B:
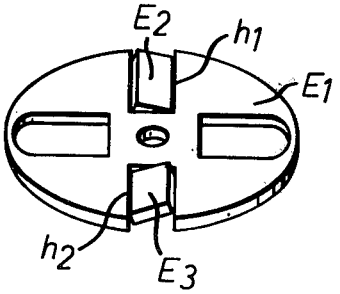
Figure 6C:
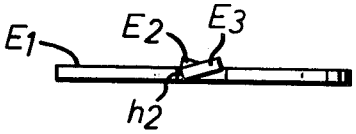
Figure 6D:
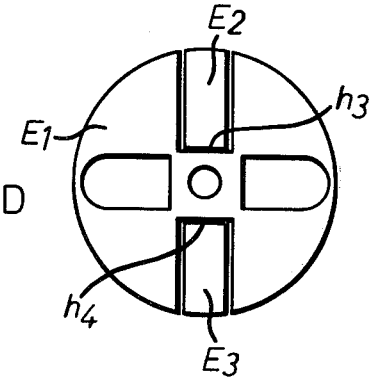

In FIGS. 6A, 6B a third plate $E_1$ has detent means comprising a pair of leaf spring members $E_2$, $E_3$ forming protuberances the hinge line $h_1$, $h_2$ being staggered asymmetrical of the centre line of the plate. In FIG. 6C the hinge line $h_3$, $h_4$ is asymmetrical of the centre line of the plate. These plates may be of integral construction and made from nylon for example.

I claim:

1. An obturator, comprising:

an outer housing having an inner surface with a key means extending inwardly of said inner surface;

an outer first plate rotatably disposed in said housing, having a first arcuate keyway for cooperating with said key means to allow limited rotation of said first plate with respect to said housing, two apertures for accepting prongs, and first means for anchoring a spring;

a second plate rotatably disposed in said housing adjacent said first plate, having a second arcuate keyway for cooperating with said key means to allow limited rotation of said second plate with respect to said housing, two apertures for accepting prongs capable of alignment with the apertures of said first plate, and second means for anchoring a spring;

spring means cooperating with said first and second means for anchoring for rotatably urging said first and second plates to a first position in which the apertures of said first and second plates are not aligned;

an inner third plate fixed with respect to said housing adjacent said second plate, having a first pair of apertures for accepting prongs capable of alignment with the apertures of said second plate but being unaligned with the apertures of said second plate when said second plate is in said first position; and two reciprocating detents extending from the surface of said third plate, each having a first end which extends into one of the apertures of said second plate when said second plate is in said first position, to prevent rotation of said second plate, whereby said first plate may be rotated against the bias of said spring means by prongs situated in the apertures of said first plate so that the apertures of said first plate become aligned with the apertures of said second plate, whereupon the ends of said reciprocal detents may be moved toward said third plate by the prongs and said first and second plates may be rotated with respect to said third plate by the prongs so that the apertures of said second plate are aligned with said first pair of apertures of said third plate, relative rotation between said second and third plates being prevented unless each of said detents is moved.

2. An obturator as claimed in claim 1, wherein said third plate is provided with a second pair of apertures aligned with the apertures of said second plate when said second plate is in said first position, with said detents extending through said second pair of apertures and being resiliently urged by springs.

3. An obturator as claimed in claim 2, wherein said first plate is provided with a spigot which extends from the surface of said first plate and said second and third plates are each provided with a central aperture for accepting said spigot, and said spring means is a spring coiled around said spigot.

* * * * *